United States Patent [19]

Koinuma et al.

[11] Patent Number: 4,489,254

[45] Date of Patent: Dec. 18, 1984

[54] MAGNETRON

[75] Inventors: Tokuju Koinuma, Kawasaki; Norio Tashiro, Yokohama; Kaizo Yamamoto, Atsugi, all of Japan

[73] Assignees: Tokyo Shibaura Denki Kabushiki Kaisha, Kawasaki; Nippon Hoso Kyokai, Tokyo, both of Japan

[21] Appl. No.: 385,399

[22] PCT Filed: Sep. 22, 1981

[86] PCT No.: PCT/JP81/00250

§ 371 Date: May 19, 1982

§ 102(e) Date: May 19, 1982

[87] PCT Pub. No.: WO82/01101

PCT Pub. Date: Apr. 1, 1982

[30] Foreign Application Priority Data

Sep. 22, 1980 [JP] Japan ..... 55-130762
Apr. 22, 1981 [JP] Japan ..... 56-60833

[51] Int. Cl.[3] ..... H01J 25/50

[52] U.S. Cl. ..... 315/39.51; 313/338; 313/449; 315/39.63; 331/91

[58] Field of Search ..... 315/39.51, 39.63; 331/88, 91; 313/338, 337, 449, 458, 459

[56] References Cited

U.S. PATENT DOCUMENTS

| | | | |
|---|---|---|---|
| 2,784,346 | 3/1957 | Dodds | 315/39.63 |
| 2,808,568 | 10/1957 | Cuccia | 315/39.63 X |
| 2,826,719 | 3/1958 | Donal, Jr. | 315/39.63 |
| 2,967,264 | 1/1961 | Dench | 315/39.63 |
| 3,443,150 | 5/1969 | Staats | 315/39.63 X |
| 3,742,293 | 6/1973 | Chavanat et al. | 315/39.63 |

FOREIGN PATENT DOCUMENTS 49-91373 8/1974 Japan .

*Primary Examiner*—Saxfield Chatmon
*Attorney, Agent, or Firm*—Cushman, Darby & Cushman

[57] ABSTRACT

Disclosed is a magnetron for a microwave oven which has a drain electrode (60) near a cathode (25) and in a position where an electron beam path is not interfered with. The cathode and the drain electrode are formed in spiral shapes. Turns of the cathode are alternately arranged with those of the drain electrode. When the magnetron is operated, the drain electrode is kept at the same potential as the cathode or is kept at a negative potential relative to that of the cathode. Therefore, positive ions in the vicinity of the cathode are collected at the drain electrode, thus decreasing high frequency noise.

8 Claims, 23 Drawing Figures

MAGNETRON

TECHNICAL FIELD

The present invention relates to an improvement in a magnetron and, more particularly, to an improvement in a continuous wave oscillation type magnetron suitable for microwave heating in an electronic oven or a pulse oscillation type magnetron suitable for a radar device.

BACKGROUND ART

Electronic equipment which uses a magnetron to generate microwave energy, such as microwave ovens and industrial microwave heating devices, is widely used these days. Along with the development of such electronic equipment, the regulation for suppressing unnecessary radio waves, that is, high frequency noise, has become serve. Noise regulations established by the International Special Committee on Radio Interference (CISPR) are in practice in some countries and are under consideration in other. Therefore, it is desired that measures be taken to further reduce the noise or unnecessary radio waves produced from the magnetron and their leakage.

The conventional structure of the magnetron for microwave ovens and the noise generated therefrom will be described below. FIG. 1 shows the magnetron structure for an microwave ovens of, for example, 2.45 GHz. Reference numeral (21) denotes the magnetron oscillation main body; (22), a radiator; (23), ferrite magnets; (24), the yoke; (25), the spiral directly-heated cathode; (26), the anode vane; (27), the anode cylinder; (28), the strap ring; (29), the output section; (29*a*), the antenna feeder; (30), the pair of pole pieces; (31), the cathode stem assembly as an input section of the magnetron; (31*a*), the insulating cylinder; (36), the choke coil; (37), the through type capacitor; (37*a*), the cathode input terminal; and (38), the shield box. A voltage of several thousands (V) is applied between the anode vane (26) and the cathode (25). A magnetic flux parallel to the axis of the cathode, that is, the axis of the cylinder is induced in an interaction space (39) between the ferrite magnets. Oscillation is thus performed. The oscillated microwave is supplied to an external load from the output section through the antenna feeder. Noise and dominant microwave oscillation are mixed in the microwave oscillation generated from the output section. An unnecessary high frequency noise component is leaked through a filter circuit which comprises the cathode input terminal, the choke coil as part of an input lead wire connected to the cathode input terminal, and a through type capacitor. This noise component varies from several tens Hz to several GHz. The filter circuit acts to attenuate a noise component leaked to a power source transformer and commercial power lines. However, in order to prevent the leakage described above, a high quality filter circuit must be used.

The noise component leaked toward the input lines is measured by the measuring circuit of FIG. 2. As shown in FIG. 3, a spectrum in which the noise component is continuously plotted until near 1,000 MHz is detected. However, in this case, the filter circuit with the choke coil and the capacitor shown in FIG. 1 is not used. Referring to FIG. 2, reference numeral (20) denotes a magnetron similar to the magnetron shown in FIG. 1; (40), a waveguide; (41), a dummy load; (42), a cathode power source; (43), a high voltage power source; (44), cathode input lines; (45), a measuring probe such as a ferrite clamp; and (46), a spectrum analyzer.

The following assumption can be made about the causes of the continuous range of magnetron noise. FIG. 4 illustrates a model of the anode and the cathode which are coaxial to the magnetron. Assume that the cathode is defined as the negative terminal and the anode is defined as the positive terminal, and that a high voltage of several thousands (V) is applied across the magnetron to emit thermoelectrons from the cathode. As indicated by the broken curve (a), the potential curve is of a concave shape and the potential is minimized in the active space (39). Meanwhile, since a DC magnetic field of 1,000 to 2,000 gauss is applied to the active space in the direction of the cathode axis as indicated by arrow (B), electrons emitted from the cathode orbit rotate around the cathode due to the relation between the electric field and the magnetic field. Because the magnetron is a crossed-field microwave tube, it has an especially long electron path. Therefore, the electrons tend to collide against the residual gas and generate a great amount of positive ions (+), compared to other linear beam electron tubes. These positive ions stay at the minimum potential as indicated by recessed portion (m) of the curve (a). The electrons in the active space are gradually neutralized with the positive ions. As a result, a potential in the active space indicated by the recessed portion (m) is increased, as indicated by reference symbol (n). The potential becomes equal to or slightly higher than that in the cathode (25). In this condition, the potential curve for the active space (39) is changed as shown by solid curve (b). In the next step, the electron charge in the active space serves to form the recessed portion (m) of the potential curve again. The position of the recessed portion (m) is estimated to be formed at about several tens μm to several hundreds μm from the cathode surface. This process is repeated periodically. As a result, a complicated pulsation phenomenon occurs in a current between the cathode and the anode, that is, an anode current. This anode current becomes a low frequency component, for example, a noise of several tens Hz to several mega heltz. In the vicinity of the recessed portion (minimum potential) of the curve, a plasma which is a mixture of electrons and ions is produced, and plasma vibration occurs within the plasma. This vibration is the cause of a relatively high frequency noise of, for example, several mega heltz to several hundreds MHz. It is presumed that these low and high frequency noise components are leaked to the external circuit. Therefore, the noise components constitute a relatively low frequency of less than 1,000 MHz. These noise components are leaked mainly through the input lines, and are called line noise. Furthermore, these noise components result in a variety of radio wave interference.

In order to decrease the noise components based on this assumption of the cause of noise, the recessed portion of the curve, that is, the minimum potential in the vicinity of the cathode must be substantially eliminated. Alternatively, the positive ions floating in the active space must be immediately eliminated. The unstable variation in the recessed portion of the curve can thus be eliminated.

A magnetron with a control grid near a cathode to control output power is already known. For example, a grid which controls output power is described on page 85 with reference to FIG. 2 in "CROSSED-FIELD MICROWAVE DEVICES", Vol. 11, 1961 edited by E. OKRESS. A magnetron with a grid is also described from page 293 in "Goku-cho-tampa ji-den-kan no ken-kyu (Study on Microwave Magnetron)", 1952, Misuzu-shobo, edited by Tomonaga and Kotani. The former grid controls the output power variable and the latter grid measures noise with a triode. The latter grid shows that changes in grid voltage are substantially independent of noise. On the other hand, the former grid which controls the output power is arranged to substantially surround the cathode with respect to the anode vane in order to control the electron stream. It is installed at a great distance from the cathode. Therefore, the grid does not act to catch positive ions floating near the cathode to decrease high frequency noise.

DISCLOSURE OF INVENTION

It is an object of the present invention to decrease high frequency noise generated from the magnetron itself. In a magnetron as a crossed-field microwave tube, ionization of the residual gas in the tube cannot be avoided. However, an electrode is installed in the vicinity of the cathode and in a position where the electron beams from the cathode to the anode are not interfered with. This electrode is electrically isolated from the cathode and self-biased. Alternatively, the electrode has the same potential as that of the cathode, or functions to apply a negative potential to the cathode. Thus, high frequency noise due to changed ion in potential minimum in an active space near the cathode is decreased.

This electrode is described as a drain electrode herein.

When the magnetron according to the present invention is operated, the cathode is heated and emits thermoelectrons. However, because a high voltage of several thousands (V) is applied between the cathode and the anode vane, and a DC magnetic field of about 1,500 gauss which has fluxes parallel to the axis of the tube is applied to the electron active space, the magnetron performs oscillation. Microwave energy generated in cavity is transmitted to an external load from the output section. When the cathode is heated and the recessed portion of the potential curve is formed as shown in FIG. 4, that is, when the drain electrode is not incorporated, the positive ions at the minimum potential have a potential higher than that at the drain electrode when a voltage of −200 (V) is applied to the drain electrode relative to the voltage of the cathode. Therefore, the positive ions are immediately caught by the drain electrode. The positive ions do not stay near the cathode but flow into the drain electrode. Therefore, the unstable neutralization phenomenon between the electrons and ions near the cathode does not occur. As a result, high frequency noise, especially in the order of 1,000 MHz or less is reduced.

BEST MODE OF CARYING OUT THE INVENTION

Figure 1:
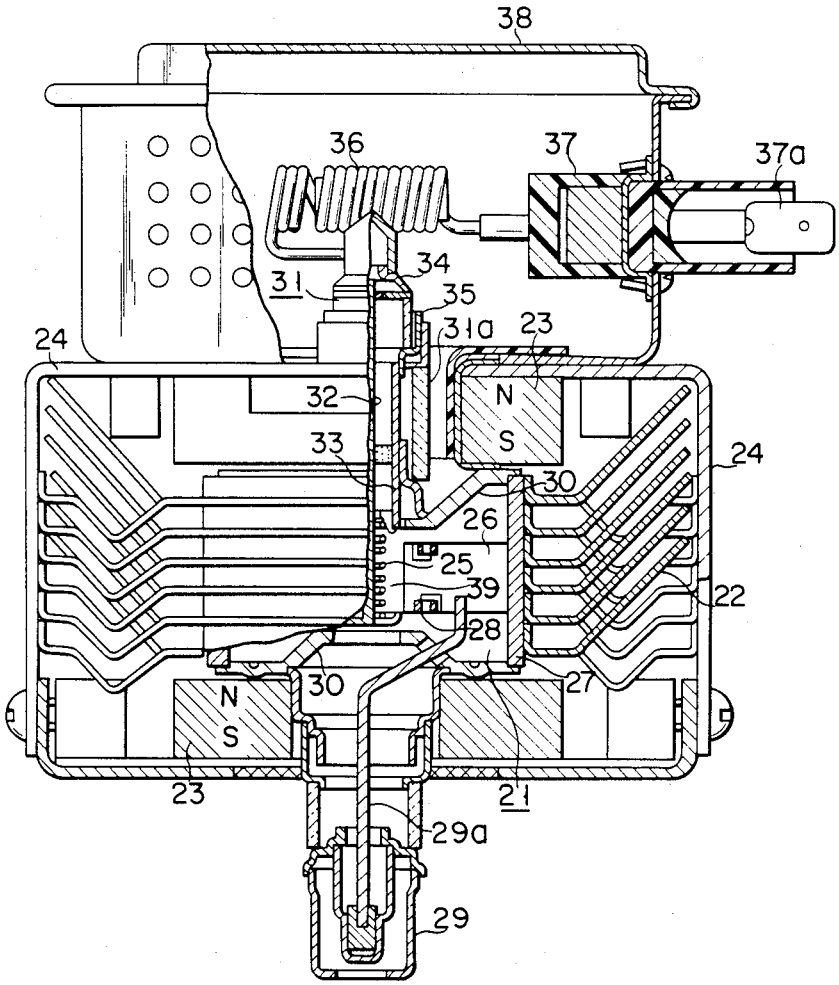
FIG. 1 is a longitudinal sectional view of the overall arrangement of a conventional magnetron.

The same reference numerals throughout the drawings denote the same parts, and a description thereof will not be repeated.

A magnetron according to one embodiment of the present invention will be described with reference to FIGS. 5*a* and 5*b*.

In the above embodiment, only a magnetron oscillation main body is illustrated. The radiator, the magnetic circuit, the shield box, and the filter circuit of the magnetron shown in FIGS. 5*a* and 5*b* are constructed in the same manner as in the magnetron shown in FIG. 1. The cathode assembly is described in detail. An end hat (51*a* ), a ceramic insulator (52), and a conductive block (53) are sequentially mounted at one end of a rod-shaped cathode support (32) disposed on the axis of the tube. The other end of the cathode support (32) is joined with a cathode terminal (35) and an exhaust pipe (54). One end of a sleeve-shaped cathode support (33) is insulated by a ceramic spacer (55) and coaxial therewith, and is connected to a stepped cylindrical component (56). The other end of the cathode support (33) is connected to another cathode terminal (34). A thorium-tungsten directly-heated cathode (25) of spiral shape is connected between a cylindrical component (56) and a conductive block (53). The cathode (25) is then heated by power supplied to the cathode terminals (34) and (35).

A sleeve-shaped drain electrode support (57) which is insulated from the sleeve-shaped cathode support (33) is coaxial therewith and sealed to a drain electrode terminal (58) hermetically connected to the upper end of the insulating cylinder (31*a*). The conductive sleeve (59) and the end hat (51) are connected to the lower end of the drain electrode support (57). One end of a drain electrode (60) spirally formed around the conductive sleeve (59) is fixed thereat. The drain electrode (60) is wound at the same pitch and the same spiral diameter as those of the cathode (25). The other end of the drain electrode (60) is mechanically held by mechanical fitting or welding on the outer circumference of the ceramic insulator (52). The other end of the drain electrode (60) is electrically a free end. The drain electrode (60) is made of a simple substance of a refractory metal such as W, Mo, Ta and Ti, or of an alloy having the refractory metal as its major constituent. It is formed on the surface on which the primary and secondary emissions are not good. As shown in the figure, the drain electrode (60) is disposed near the cathode and is in a position where the electron stream from the cathode to the anode is not interfered. For example, in a magnetron whose output power is about 800 (W) at 2.45 GHz, the wire diameters of the cathode and drain electrodes are 0.58 mm and 0.5 mm, respectively. The pitch of them is the same, 2.0 mm. The spiral diameter is 5.0 mm and the inner diameter of the anode vane top is 10 mm. Therefore, the spiral turns of the cathode electrode and the drain electrode are alternately disposed in an interval of 1 mm on the same plane. Reference numerals (31*b*) and (31*c*) denote ceramic insulating cylinders. The anode vane (26) and the anode cylinder constitute a plurality of cavities. The plurality of cavities constitute the anode as a whole. The cathode supports (32) and (33), the drain electrode support (57), the end of the ceramic insulating cylinder for supporting the end of the drain electrode support (57), and the respective electrode terminals (34), (35) and (58) constitute the cathode stem assembly (31) as a whole.

Figure 6:
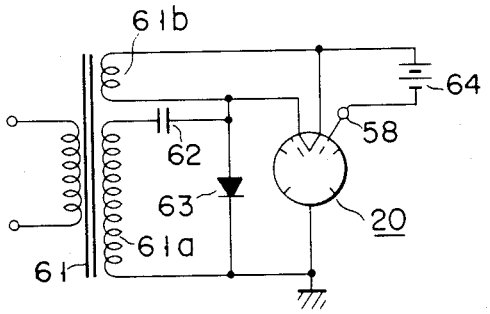
FIG. 6 is a circuit diagram of the magnetron which explains one example of the mode of operation.

The magnetron (20) with the above arrangement according to one embodiment of the present invention is connected to a power source circuit shown in FIG. 6 and operated. Referring to FIG. 6, reference numeral (61) denotes a leakage transformer, the primary winding of which is connected to a commercial power source and the secondary winding of which comprises a high voltage winding (61*a*) and a cathode heating winding (61*b*). Reference numeral (62) denotes a paper capacitor of about 0.5 $\mu$F; (63), a diode for rectifying the high voltage; and (64), a power source for applying a voltage between the cathode and the drain electrode. With the power source (64), the same voltage as applied across the cathode is applied across the drain electrode, or a desired negative voltage is applied thereacross. The magnetron according to the present invention is operated in the manner described above and has an advantage in that high frequency noise in a relative low frequency range of less than about 1,000 MHz is lessened.

Figure 7A:
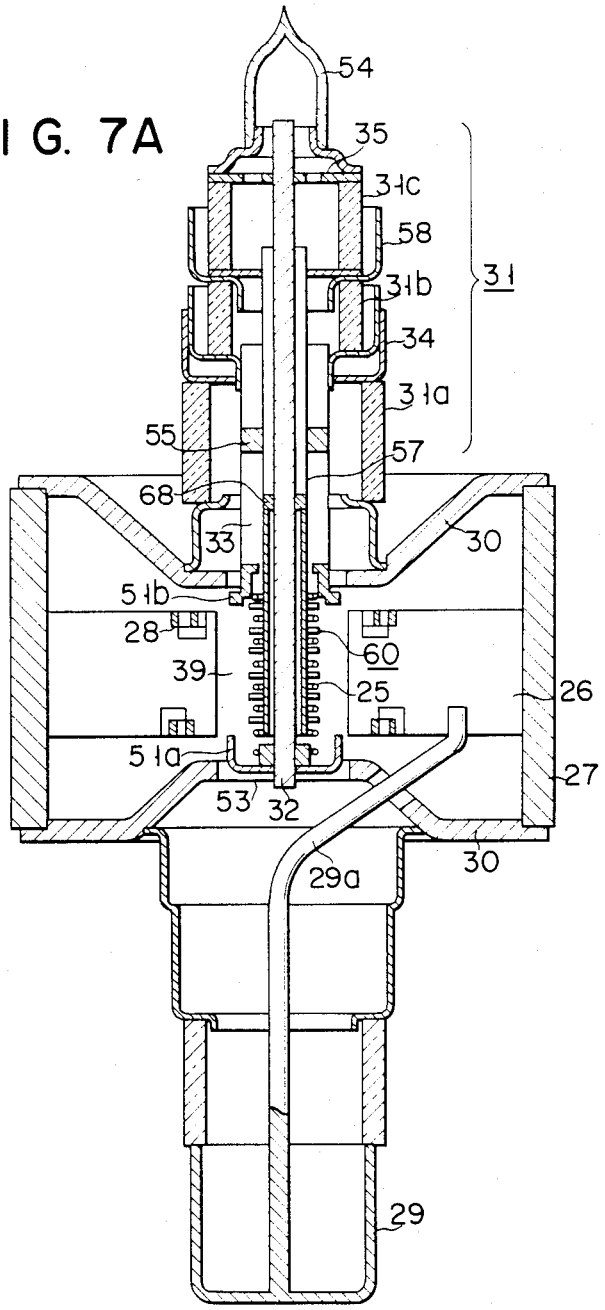
FIG. 7*a* is a longitudinal sectional view of a magnetron according to another embodiment of the present invention.
Figure 7B:
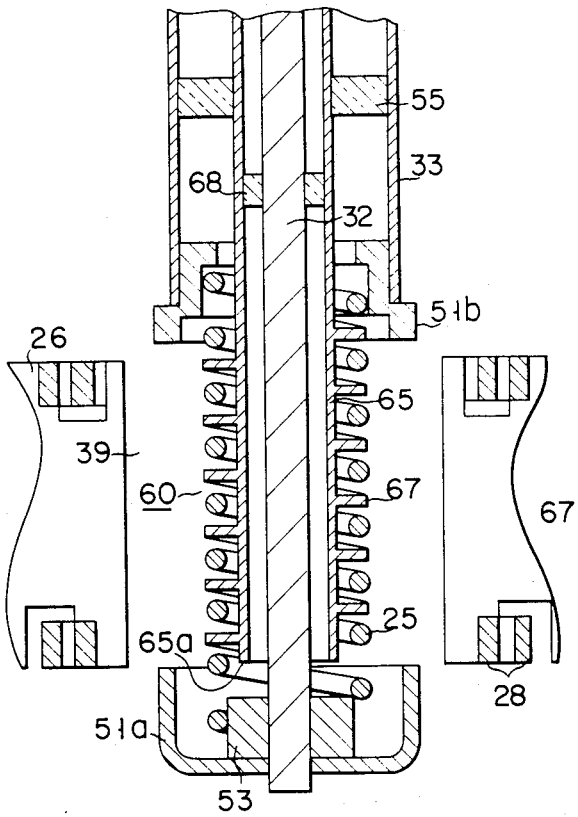
FIG. 7*b* is an enlarged sectional view of the main part of the magnetron shown in FIG. 7*a;*
Figure 7C:
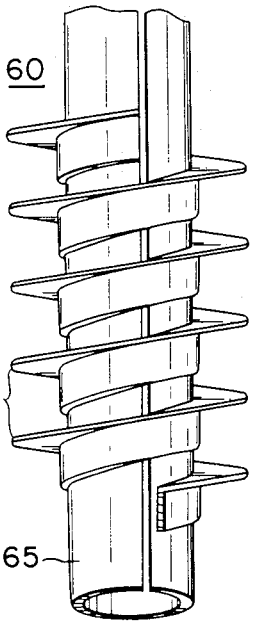
FIG. 7*c* is a perspective view of the main part of the magnetron shown in FIG. 7*b;*

A magnetron according to another embodiment of the present invention will be described with reference to FIGS. 7*a*, 7*b* and 7*c*.

If the drain electrode is mechanically supported by an insulator such as a ceramic insulator in the vicinity of the electron emission of the cathode, the electron emission portion of the cathode is heated to, an extremely high temperature and a gas is produced. Therefore, noise due to ions cannot be adequately controlled. As shown in FIGS. 7*a*, 7*b* and 7*c* , an insulator is not used in the vicinity of the electron emission portion of the cathode. Instead, the drain electrode is kept in the floating state. The drain electrode in the vicinity of the cathode is made of a cylindrical base body and is mechanically supported through an insulator in the cathode stem assembly or in the vicinity thereof adequately apart from the cathode.

In this embodiment, the sleeve-shaped support (57) of the drain electrode is coaxially disposed inside the sleeve-shaped cathode support (33). The sleeve-shaped support (57) is connected to the drain electrode terminal (58) which is hermetically joined with the upper end of the insulating cylinder (31*a*). The drain electrode (60) is disposed at the lower end of the drain electrode support (57). The drain electrode (60) has a conductive cylindrical base body (65) whose diameter is smaller than the spiral inner diameter of the cathode (25). Spiral protrusions (67) extend from the outer circumference of the base body (65) and between adjacent spiral turns of the spiral cathode. The lower end (65*a*) of the base body (65) is a free end and is not connected to an insulator or the like. The stem of the base body (65) is held at the rod-shaped cathode support (32) by a ceramic insulator (68) above the end hat (51*b*) and the pole piece (30) in the figure. The end of the base body (65) is fitted into the central hole of the drain electrode terminal (58) which constitutes part of the cathode step assembly (31) and is held mechanically. The drain electrode (60) is held on the cathode support through the insulator at a position adequately apart from the electron emission portion of the cathode (25). The top of the drain electrode (60) is a free end. The protrusions (67) of the drain electrode (60) extend between the turns of the spiral cathode (25) and extend to the outer circumference of the cathode. The drain electrode which is made of a simple substance such as the refractory metals W, Mo, Ta and Ti, or of an alloy having the refractory metal as the major constituent, is preferably formed on the surface of which primary and secondary electron emission is not good. Furthermore, as shown in the figure, the drain electrode is disposed near the cathode in a position where the electron beam from the cathode to the anode is not interfered with.

According to the above embodiment, the drain electrode is constituted of the cylindrical base body and the protrusions formed on the outer circumference thereof. The drain electrode is mechanically supported by itself or by the insulator. The portion of the drain electrode in the vicinity of the electron emission portion of the cathode is formed to be a free end. Therefore, even if the cathode is heated to a temperature of one hundred and several tens degrees centigrade, a gas is not produced in the vicinity thereof since an insulator which would result in gas production is not used. Noise can thus be effectively prevented without unstable operating conditions. Furthermore, when the potential of the drain electrode is kept at a negative potential, the electrons are not back-bombarded toward the drain electrode. Therefore, a gas can hardly be produced from the drain electrode itself, thus assuring a stable operation.

Figure 8:
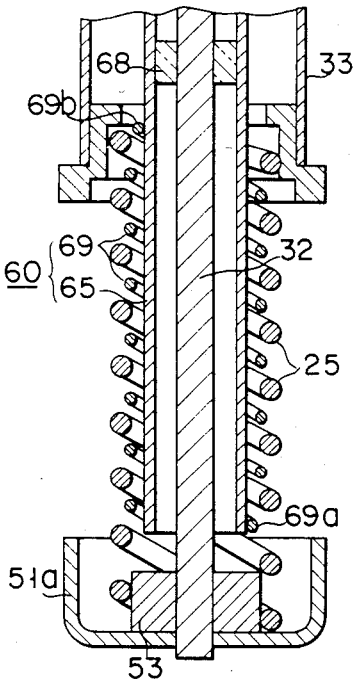
FIG. 8 is a sectional view of the main part of a magnetron according to still another embodiment of the present invention.

A magnetron according to still another embodiment of the present invention will be described with reference to FIG. 8.

In this embodiment, a conductive coil (69) is wound around the outer circumference of the cylindrical base body (65) whose outer diameter is smaller than the inner diameter of the cathode (25) with the same pitch of the turns of the cathode. The cylindrical base body (65) is comprised of Mo or Fe. Both ends (69*a*) and (69*b*) of the conductive coil (69) are connected to the cylindrical base body (65) to form the drain electrode (60).

Figure 9:
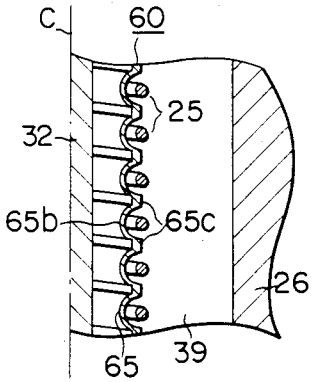
FIG. 9 is a sectional view of the main part of a magnetron according to still another embodiment of the present invention.

A magnetron according to still another embodiment of the present invention will be described with reference to FIG. 9. Spiral recesses (65*b*) and spiral protrusions (65*c*) which have the same pitch as the turns of the cathode are formed on the cylindrical base body (65) disposed inside the spiral cathode (25) to form the drain electrode (60). The cathode (25) does not come in contact with the recesses (65*b*). The outer circumferential surface of the cathode and the protrusions (65*c*) are substantially disposed on the same plane.

Figure 10:
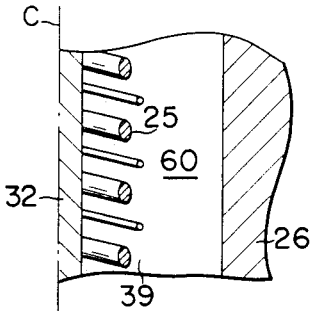
FIG. 10 is a sectional view of the main part of a magnetron according to still another embodiment of the present invention.

A magnetron according to still another embodiment of the present invention will be described with reference to FIG. 10. A cathode having a flat spiral section parallel to the axis (c) of the tube, that is, the cathode axis, is used as the electron emission cathode (25). The drain electrode (60) projects slightly (less than 1 mm) from the outer circumferential surface of the cathode (25) toward the anode (26). The protrusions of the drain electrode (60) extend between the turns of the cathode. The potential at the drain electrode is determined to be slightly negative relative to the potential at the cathode electrode. For example, if the potential at the drain electrode is determined to be −150 (V), the decrease in an anode current is suppressed to less than about 10%. Therefore, even if the potential of the drain electrode is the same as that of the cathode, the positive ions are caught, thus decreasing noise. Further, if the potential of the drain electrode is the same as that of the cathode electrode, these electrodes are preferably electrically connected through a resistor having a high resistance.

Figure 11:
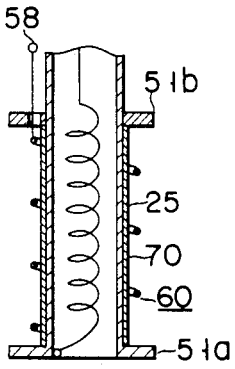
FIG. 11 is a sectional view of the main part of a magnetron according to still another embodiment of the present invention.

A magnetron according to still another embodiment of the present invention will be described with reference to FIG. 11. The indirectly heated cathode (25) is used in this case. The drain electrode (60) of a rough picth is wound around within about 1 mm from the outer circumference of the electron emission layer (70) of the cathode. The drain electrode must be wound at a smaller pitch in the vicinities of both ends of the cathode, while the drain electrode is wound with a larger pitch at the center of the cathode. Therefore, it is desired that decrease in the electron flux at the center of the cathode be drastically reduced. In the embodiment described above, the cathode and the drain electrodes are separately assembled and insulated from each other. However, the present invention is not limited to this arrangement. For example, a spiral cathode and a spiral drain electrode may alternately be wound in units of turns or several turns. These electrodes may be electrically connected within the tube and may be set at the same potential. Alternatively, an electron emission layer may be formed on every other turn of a single spiral wire such as a tungsten wire, so that it is extremely difficult for the remaining electrons to be emitted. Even in this case, the same effects as those in the arrangement of alternate turns of the cathode and the drain electrode are obtained. The potential of the cathode is substantially the same as that of the drain electrode which comprises electron non-emitting surface. Furthermore, using a single wire such as a tungsten wire, an electron emission material may be coated on part of the tungsten wire. The remaining surface of the tungsten wire remains as the electron non-emission surface. This tungsten wire may be formed into a spiral shape so that the electron emission surface and the electron non-emission surface, which is, in effect, the drain electrode, face the anode. In this case, if the electron non-emission surface slightly extends toward the anode, the effects are further increased. The above-mentioned manufacturing processes which are described above are easy to accomplish. The positive ions are effectively caught and noise is decreased.

A practical power source circuit for applying power to the drain electrode will be described.

Figure 12:
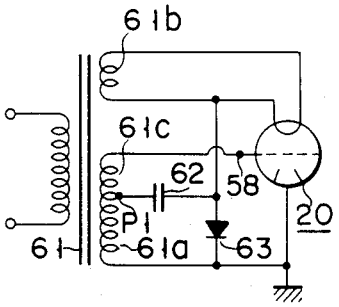
FIG. 12 is a circuit diagram of another example of a circuit for driving the magnetron according to the present invention.
Figure 13:
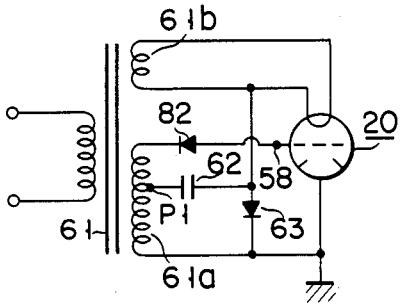
FIG. 13 is a circuit diagram of still another example of a circuit for driving the magnetron according to the present invention.
Figure 14:
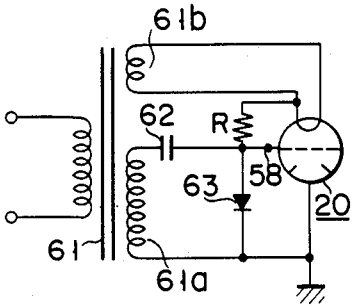
FIG. 14 is a circuit diagram of still another example of a circuit for driving the magnetron according to the present invention.

As shown in FIG. 12, a centertap (P1) is disposed on the high voltage secondary winding (61*a*) of the leakage transformer (61). A voltage multiplying rectifier comprising a capacitor (62) and a diode (63) is connected to the tap (P1). The winding (61*c*) which is formed in the leakage transformer (61) is connected to the terminal (58) of the drain electrode. In a half cycle in which a positive high voltage is applied to the anode relative to the cathode, a negative pulsation voltage is applied to the drain electrode. As a result, a relatively simple power source circuit is arranged. Further, as shown in FIG. 13, a diode (82) may be connected to the power source circuit. Alternatively, as shown in FIG. 14, a voltage may be applied across the drain electrode by a voltage multiplying rectifier which comprises a capacitor (83) and a diode (84).

Figure 15:
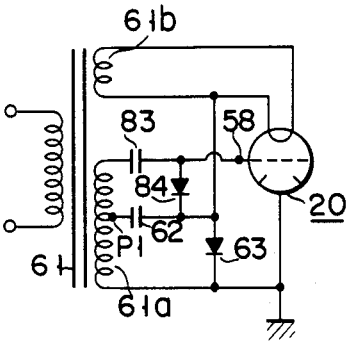
FIG. 15 is a circuit diagram of still another example of a circuit for driving the magnetron according to the present invention.

Furthermore, as shown in FIG. 15, a resistor (R) may be connected between the cathode and the drain electrode. A high voltage may be applied between the drain electrode and the anode. The anode current may flow through the resistor (R) and a self-biased voltage may be applied to the drain electrode.

Figure 16:
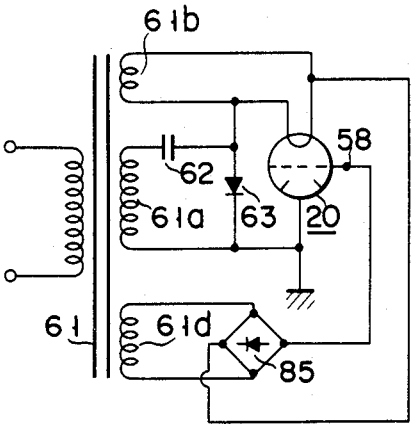
FIG. 16 is a circuit diagram of still another example of a circuit for driving the magnetron according to the present invention.

Furthermore, as shown in FIG. 16, a secondary winding (61*d*) for the power of the drain electrode may be formed in the leakage transformer (61) and a negative voltage relative to the voltage of the cathode may be applied to the drain electrode terminal (58) through a full-wave rectifier (85).

Figure 17:
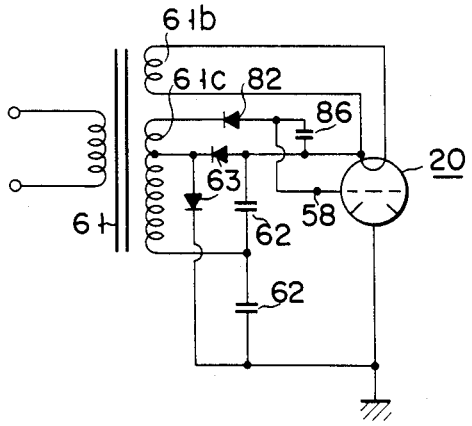
FIG. 17 is a circuit diagram of still another example of a circuit for driving the magnetron according to the present invention.

Furthermore, as shown in FIG. 17, a high voltage from the full-wave voltage multiplying rectifier and a voltage from the winding (61*c*) and a drain electrode voltage rectifier which comprises the diode (82) and the capacitor (86) may be combined to drive the drain electrode.

Figure 18:
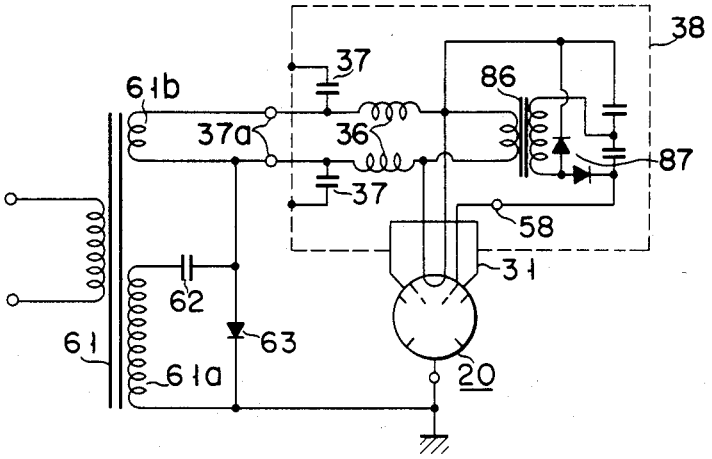
FIG. 18 is a circuit diagram of still another example of a circuit for driving the magnetron according to the present invention.

Further, as shown in FIG. 18, a small transformer (86) is installed in the shield box (38) of the magnetron, and the components of the secondary winding side of a drain voltage multiplying rectifier (87) are insulated from the shield box (38). The primary winding side of the transformer is connected to the input lines of the cathode. If a voltage of about 3 (V) is applied to the cathode, a voltage of several 10 to 100 (V) need only be obtained at the secondary winding side of the transformer (86). According to this example, the drain electrode power source is built into the magnetron. Therefore, a power source such as the leakage transformer (61) need not be modified. Additionally, since the current flowing through the drain electrode is very small, a small power source circuit can be manufactured, thus resulting in a variety of industrial applications.

INDUSTRIAL APPLICABILITY

With the magnetron according to the present invention, high frequency noise of less than about 1,000 MHz which is produced from the magnetron itself is greatly decreased. The spectrum of the oscillated microwaves is smooth. Therefore, the magnetron can be used for microwave heating devices such as microwave ovens, devices which use continuous microwave energy of relative high power, radar devices which use pulsated oscillation waves, and the like.

Since high frequency noise is lessened, radio wave interference with other electronic equipment and the human body is greatly decreased. Further, the filter circuit connected to the input side of the magnetron need not be used or may be made compact.

Results of the measurements of high frequency level which were conducted by the present inventors will be described.

Figure 2:
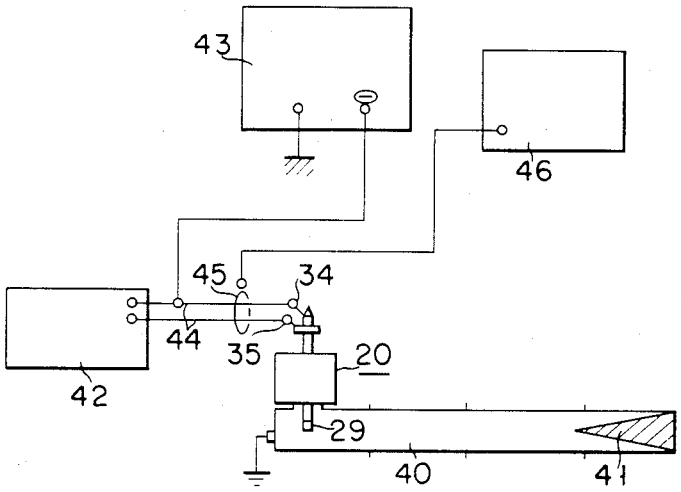
FIG. 2 is a block diagram of a noise measuring circuit.
Figure 3:
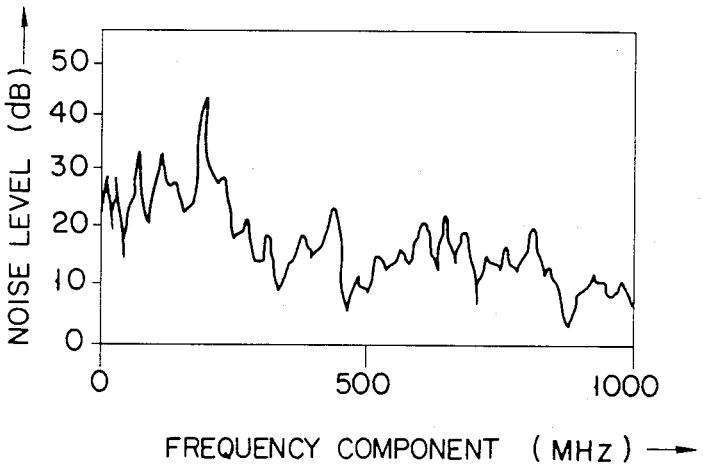
FIG. 3 is a graph which explains the level of noise generated from the magnetron.
Figure 5A:
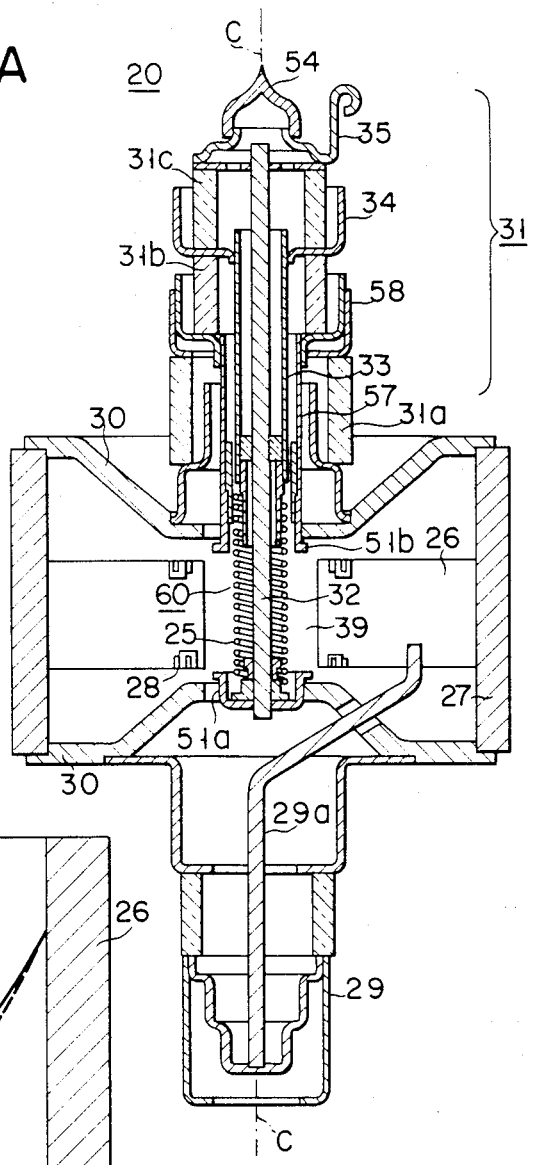
FIG. 5*a* is a longitudinal sectional view of the main part of a magnetron according to one embodiment of the present invention.
Figure 4:
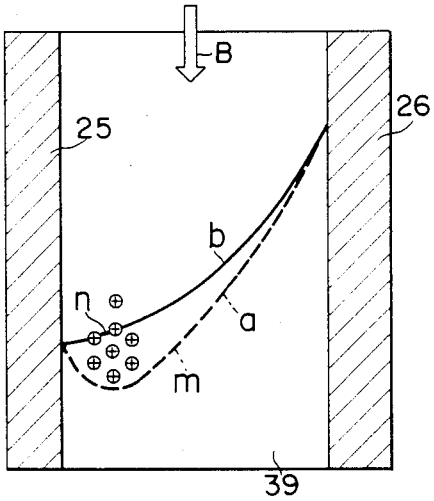
FIG. 4 is a model which explains the cause of noise generation.
Figure 5B:
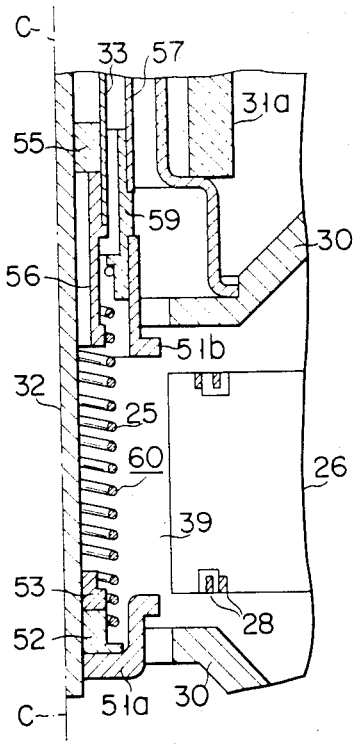
FIG. 5*b* is an enlarged view of the main part of the magnetron shown in FIG. 5*a;*
Figure 19A:
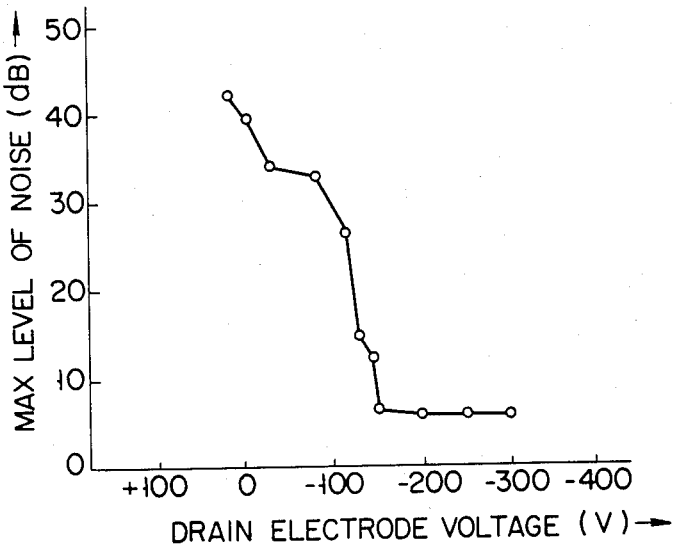
FIG. 19*a* is a graph of the noise characteristic curve of the magnetron of the present invention.

The noise level of the magnetron shown in FIGS. 5*a* and 5*b* is measured by the same measuring circuit as that shown in FIG. 2. Results are shown in FIG. 19*a*. The maximum values of the noise frequency components in the range of 0 to 100 MHz are plotted as a function of changes in voltage of the drain electrode relative to the cathode. According to the measurements, when the potential of the drain electrode is set to −150 (V), as compared with the potential of 0 (V), that is, the same potential as that of the cathode, the maximum value of noise is reduced by about 30 dB.

Figure 19B:
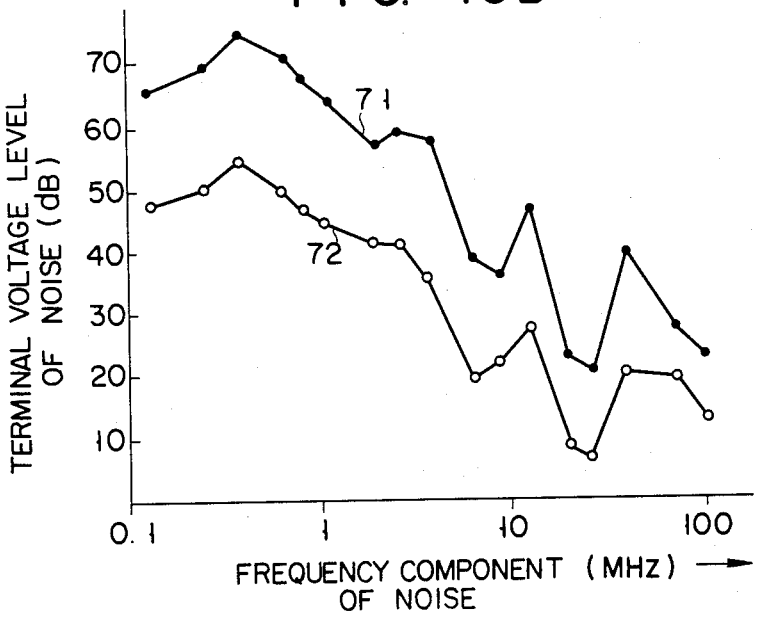
FIG. 19*b* is a graph of the noise characteristic curves of the magnetron according to the present invention and to the conventional magnetron.

The level of noise generated toward the input lines is shown in FIG. 19*b*. Peak values of the spectrum of less than 100 MHz are plotted and connected to form a curve. As compared with curve (71) in the magnetron with the conventional arrangement shown in FIG. 1, the noise is reduced by about 20 dB in the full-wave frequency component range as indicated by curve (72) when the potential of the drain electrode is set to −150 (V) in the magnetron of the embodiment of the present invention.

The above results are obtained when DC voltages are applied between the anode and cathode electrodes. When the magnetron is used in commercially available electronic ovens, the high voltage anode power source is regarded as the pulsation voltage. When the magnetron is operated by the pulsation voltage, the following results are obtained. The noise component of less than 10 MHz, especially 1 MHz, is slightly increased, while the noise component of more than 10 MHz, especially 50 MHz, is greatly decreased. In addition, even when the potential of the drain electrode is set to be equal to that of the cathode, the noise is decreased about by 10 dB as compared with the conventional arrangement without the drain electrode. Further, when the drain electrode is electrically isolated and self-bias, the noise component of about 75 MHz is decreased by about 25 dB.

According to the present invention, even if the potential of the drain electrode is set to a negative potential, for example, −200 (V) relative to the potential of the cathode, the anode current or the current between the cathode and the anode is not substantially decreased. In the above embodiment, when the spiral cathode has the same diameter as the spiral drain electrode and these electrodes are alinged on the same plane, the anode current is slightly increased when the potential of the drain relative to that of the cathode is set to be negative.

In summary, high frequency noise produced from the magnetron according to the present invention is extremely small. For this reason, the expensive line filter which is currently mounted in the magnetron and the electronic range may be eliminated.

We claim:

1. A magnetron comprising a cylindrical anode which has a plurality of cavities therein, an electron emissive cathode which is coaxial with said cylindrical anode and is disposed inside said cylindrical anode, said cathode comprising a spiral-shaped directly-heated cathode which consists of a refractorv metal as a base material, a cathode stem which electrically insulates said cathode from said cylindrical anode and supports said electron emissive cathode, a magnetic field generating device for generating a magnetic field parallel to the axis of said cylindrical cathode in an interaction space between said electron emissive cathode and said cylindrical anode, an output antenna conductor for feeding microwave energy generated from said plurality of cavities to a load, and a drain electrode installed near said spiral-shaped directly-heated cathode and in a position where electrons emitted from said cathode to said cylindrical anode are not interfered with, said drain electrode being wound at the same pitch of the turns of said spiral-shaped directly-heated cathode, and turns of said drain electrode extending between the turns of said spiral-shaped directly-heated cathode.

2. A magnetron according to claim 1 wherein said drain electrode is not in contact with turns of said spiral-shaped directly-heated cathode.

3. A magnetron according to claim 1, wherein the outer circumference of said drain electrode slightly extends from the outer circumference of said spiral-shaped directly-heated cathode toward said electron emissive anode.

4. A magnetron according to claim 1, wherein said drain electrode is comprised of a one of the simple substances W, Mo, Ta and Ti, or of an alloy containing the simple substance as its major constituent.

5. A magnetron according to claim 1, wherein a conductive cylindrical base body whose outer diameter is smaller than the inner diameter of said spiral-shaped directly-heated cathode is disposed inside said spiral-shaped directly-heated cathode, and only said conductive cylindrical base body or said conductive cylindrical base body together with other members constitutes said drain electrode.

6. A magnetron according to claim 5, wherein said drain electrode is formed by a spiral body, protrusions of which extend between the turns of said spiral-shaped directly-heated cathode.

7. A magnetron according to claim 6, wherein said cylindrical base body is self-supported or supported by said cathode stem at a position adequately apart from an electron emissive portion of said electron emissive cathode.

8. A magnetron according to claim 6, wherein said drain electrode has a spiral conductor, part of which is supported by said cylindrical base body.

* * * * *